US007832391B2

(12) United States Patent
Kellogg et al.

(10) Patent No.: US 7,832,391 B2
(45) Date of Patent: Nov. 16, 2010

(54) RANGE EXHAUST CLEANING SYSTEM

(75) Inventors: David Alan Kellogg, Walker, MN (US); David Paul Smieja, Hackensack, MN (US); Ryan Dietrich Bruns, Walker, MN (US)

(73) Assignee: Kellogg, Bruns & Smeija, LLC, Walker, MN (US)

( * ) Notice: Subject to any disclaimer, the term of this patent is extended or adjusted under 35 U.S.C. 154(b) by 605 days.

(21) Appl. No.: 11/373,474

(22) Filed: Mar. 10, 2006

(65) Prior Publication Data

US 2007/0209655 A1 Sep. 13, 2007

(51) Int. Cl.
*F24C 15/20* (2006.01)

(52) U.S. Cl. ..... 126/299 E; 126/16; 454/53; 454/54; 454/55

(58) Field of Classification Search ..... 55/242, 55/328, 493, 444; 126/299 D, 299 E, 299 F, 126/16; 454/49, 53, 54, 55
See application file for complete search history.

(56) References Cited

U.S. PATENT DOCUMENTS 2,539,344 A * 1/1951 Carraway ..... 261/3
2,813,477 A * 11/1957 Gaylord ..... 126/299 E
2,992,414 A * 7/1961 Viehe ..... 377/101
3,055,285 A * 9/1962 Gaylord ..... 126/299 E
3,207,058 A * 9/1965 Gaylord ..... 126/299 E
3,242,652 A * 3/1966 Malenchini ..... 96/233
3,324,629 A * 6/1967 Graswich et al. ..... 95/150
3,381,679 A 5/1968 Gonzalez
3,433,146 A * 3/1969 Russell ..... 126/299 E
3,448,808 A * 6/1969 Olson et al. ..... 169/59
3,463,233 A * 8/1969 Haessler ..... 169/47
3,490,206 A * 1/1970 Doane ..... 96/228
3,539,153 A * 11/1970 Cargo et al. ..... 366/146
3,564,989 A * 2/1971 Williams et al. ..... 454/67
3,589,609 A * 6/1971 Wyant et al. ..... 239/120
3,616,744 A 11/1971 Jensen
3,628,311 A * 12/1971 Costarella et al. ..... 96/228
3,640,793 A 2/1972 Scott
3,653,179 A * 4/1972 Doane ..... 95/267

(Continued)

FOREIGN PATENT DOCUMENTS

AU 2004201371 A1 3/2004

(Continued)

*Primary Examiner*—Kenneth B Rinehart
*Assistant Examiner*—Jorge Pereiro
(74) *Attorney, Agent, or Firm*—Schwegman, Lundberg & Woessner, P.A.

(57) ABSTRACT

A cleaning system for a cooking range exhaust having a hood, a backsplash, and a flue for exhausting cooking effluent is disclosed. The cleaning system includes a fluid delivery system constructed for placement within the cooking range exhaust. The fluid delivery system includes a hood spray conduit constructed for placement within the hood and comprising spray openings for directing a degreasing composition to the backsplash. The fluid delivery system includes a flue spray conduit constructed for placement within the flue and comprising spray openings for directing the degreasing composition to an interior surface of the flue. The cleaning system includes a pump system constructed for conveying the degreasing composition from a degreasing composition source and through the fluid delivery system. The cleaning system includes a collection reservoir constructed to collect degreasing composition runoff from the cooking range exhaust. A method of cleaning a cooking range exhaust and a self-cleaning exhaust system are also disclosed.

27 Claims, 9 Drawing Sheets

U.S. PATENT DOCUMENTS 3,731,462 A * 5/1973 Costarella et al. ..... 96/240
3,795,181 A 3/1974 Lawson
3,824,374 A * 7/1974 Mayher ..... 219/510
3,893,831 A * 7/1975 Doane ..... 96/228
3,907,525 A * 9/1975 King ..... 96/53
4,011,101 A * 3/1977 Levenback et al. ..... 134/10
4,022,118 A * 5/1977 Vandas ..... 126/299 E
4,031,910 A * 6/1977 Lawson ..... 134/167 C
4,066,064 A * 1/1978 Vandas ..... 126/299 E
4,084,947 A * 4/1978 Ear ..... 96/233
4,085,735 A 4/1978 Kaufman et al.
4,103,676 A * 8/1978 Kastner ..... 126/299 E
4,231,769 A * 11/1980 Ahlrich ..... 96/229
4,259,945 A 4/1981 Lawson
4,539,024 A * 9/1985 Stehning et al. ..... 96/232
4,784,114 A * 11/1988 Muckler et al. ..... 126/299 E
4,822,385 A * 4/1989 Strege et al. ..... 96/334
4,834,188 A * 5/1989 Silverman ..... 169/65
4,990,167 A * 2/1991 Stehning ..... 96/228
5,025,361 A * 6/1991 Pitman et al. ..... 700/14
5,038,807 A * 8/1991 Bailey et al. ..... 134/57 D
5,042,457 A * 8/1991 Gallagher ..... 126/299 E
5,127,479 A * 7/1992 Stehling et al. ..... 169/65
5,158,429 A 10/1992 Chiang et al.
5,235,963 A * 8/1993 Strause ..... 126/299 E
5,257,171 A * 10/1993 Hara ..... 700/14
5,323,762 A 6/1994 Chiang et al.
5,359,990 A * 11/1994 Hsu ..... 126/299 E
5,472,342 A * 12/1995 Welsh et al. ..... 126/299 E
5,642,784 A 7/1997 Guay et al.
5,662,097 A 9/1997 Panos
5,697,839 A 12/1997 Chen et al.
5,860,412 A * 1/1999 Way ..... 126/299 E
5,874,292 A 2/1999 McMinn, Jr.
5,960,804 A * 10/1999 Cooper et al. ..... 134/56 D
5,975,075 A * 11/1999 Ide ..... 126/299 D
6,125,841 A * 10/2000 Boudreault ..... 126/299 D
6,170,480 B1 * 1/2001 Melink et al. ..... 126/299 R
6,223,741 B1 5/2001 Panos
6,274,375 B1 8/2001 McMinn, Jr.
6,357,459 B1 * 3/2002 Loughmiller ..... 134/167 R
6,457,481 B1 10/2002 Tarala
6,532,972 B2 * 3/2003 Tarala ..... 134/22.18
6,655,393 B2 * 12/2003 Loughmiller ..... 134/22.12
6,662,800 B2 12/2003 Yeung
6,712,068 B1 3/2004 Yeung
6,817,356 B2 11/2004 Gallagher
6,848,140 B2 * 2/2005 Cho ..... 8/159
6,851,422 B2 2/2005 Yeung
6,874,497 B2 4/2005 Yeung
6,880,551 B2 4/2005 Yeung
6,895,954 B2 5/2005 Swierczyna et al.
6,895,957 B2 5/2005 Yeung
6,983,628 B2 * 1/2006 Cho ..... 68/12.01
7,104,263 B1 9/2006 Chen
2002/0026673 A1 * 3/2002 Cho ..... 8/159
2002/0028501 A1 3/2002 McMinn, Jr.
2003/0037782 A1 2/2003 Yeung
2003/0192529 A1 10/2003 Yeung
2004/0045544 A1 3/2004 Yeung
2004/0055592 A1 3/2004 Yeung
2004/0237958 A1 12/2004 Yeung
2005/0016523 A1 1/2005 Yeung
2005/0081842 A1 4/2005 Yeung
2005/0108326 A1 * 5/2005 Tuttle ..... 709/203
2005/0178378 A1 * 8/2005 Marshall et al. ..... 126/299 D
2005/0247244 A1 11/2005 So
2005/0274398 A1 * 12/2005 Fonville et al. ..... 134/34
2007/0044789 A1 3/2007 Grieco

FOREIGN PATENT DOCUMENTS

EP 1175173 1/2002
EP 1464413 10/2004
GB 2 392 240 A 2/2004
GB 2 393 507 A 3/2004
JP 5000218 1/1993
JP 9189441 7/1997
JP 9189440 9/1997
JP 10-185264 7/1998
JP 11-63612 3/1999
JP 11063613 3/1999
JP 11118220 4/1999
JP 2001304213 2/2001
WO WO-0049220 8/2000

* cited by examiner

RANGE EXHAUST CLEANING SYSTEM

TECHNICAL FIELD

The present invention relates to a cooking range exhaust cleaning system, and to a method for cleaning a cooking range exhaust.

BACKGROUND

Range exhaust systems installed in conjunction with cooking ranges generally include a range hood and exhaust flue, and are used to draw smoke, odor, grease, and other types of cooking effluent away from a cooking surface. In drawing the effluent away from the cooking range, the grease and other substances accumulate on the surfaces of the hood and exhaust flue. The surfaces of the cooking range exhaust, when covered in accumulated cooking effluent, are therefore a significant fire hazard because grease and other highly flammable effluent are retained near the hot cooking area.

Because of the significant fire danger involved in cooking below accumulated grease and other cooking effluent in a cooking range exhaust, the surfaces of the range hood and flue must be cleaned regularly. However, cleaning the exhaust flue and the backsplash in the range hood is particularly difficult due to the confined, remote area involved. For this reason, restaurants with cooking areas having such cooking range exhausts clean these difficult to reach portions of the cooking range exhaust periodically. Cleaning of these difficult to reach areas can be costly, messy, and can require closure of the kitchen during the cleaning process.

SUMMARY

A cleaning system for a cooking range exhaust having a hood, a backsplash, and a flue for exhausting cooking effluent is disclosed. The cleaning system includes a fluid delivery system constructed for placement within the cooking range exhaust. The fluid delivery system includes a hood spray conduit constructed for placement within the hood and comprising spray openings for directing a degreasing composition to the backsplash. The fluid delivery system also includes a flue spray conduit constructed for placement within the flue and comprising spray openings for directing the degreasing composition to an interior surface of the flue. The cleaning system includes a pump system constructed for conveying the degreasing composition from a degreasing composition source and through the fluid delivery system. The cleaning system further includes a collection reservoir constructed to collect degreasing composition run off from the cooking range exhaust.

A method of cleaning a cooking range exhaust having a hood, a backsplash, and a flue is also disclosed. The method includes spraying a degreasing composition on the backsplash and an interior surface of the flue, the degreasing composition stored at a degreasing composition source and sprayed by a pump system connected to a fluid delivery system. The method also includes rinsing the backsplash and the interior surface of the flue with water drawn from a water source by the pump system and sprayed via the fluid delivery system.

A self-cleaning exhaust system is also disclosed. The system includes a cooking range exhaust including a hood, a backsplash, and a flue having a flue opening into the hood, wherein the hood is provided in proximity to a cooking area to recover cooking effluent when the cooking range is operated. The system also includes a fluid delivery system mounted on the cooking range exhaust. The fluid delivery system includes a hood spray conduit and a flue spray conduit. The hood spray conduit is provided within the hood and includes spray openings provided to deliver a degreasing composition to the backsplash. The flue spray conduit is provided within the flue and including spray openings to deliver the degreasing composition to an interior surface of the flue. The system further includes a pump system constructed for conveying the degreasing composition from a degreasing composition source and through the fluid delivery system. The system includes a collection reservoir constructed to collect degreasing composition run off from the cooking range exhaust.

DETAILED DESCRIPTION

The present disclosure relates generally to a cleaning system for a cooking range exhaust, and a method of using a cleaning system to clean a cooking range exhaust. The disclosure contemplates a cleaning system constructed for use in conjunction with a cooking range exhaust. The cooking range exhaust of the present disclosure generally is a range exhaust having a hood, a backsplash, and a flue that can be found in proximity to cooking areas in restaurants and other kitchen settings. The cleaning system is generally configured to remove cooking effluent from portions of the cooking range exhaust. The cooking effluent to be removed can include grease, smoke residue, and other contaminants. The cleaning system can use a degreasing composition to remove the cooking effluent. While the invention is being described in the context of a number of preferred embodiments, it will be appreciated that the invention can be used in a wide variety of arrangements and on a variety of cooking range exhaust configurations. The invention can work in conjunction with cooking exhaust systems having straight or angled flue configurations.

Figure 1:
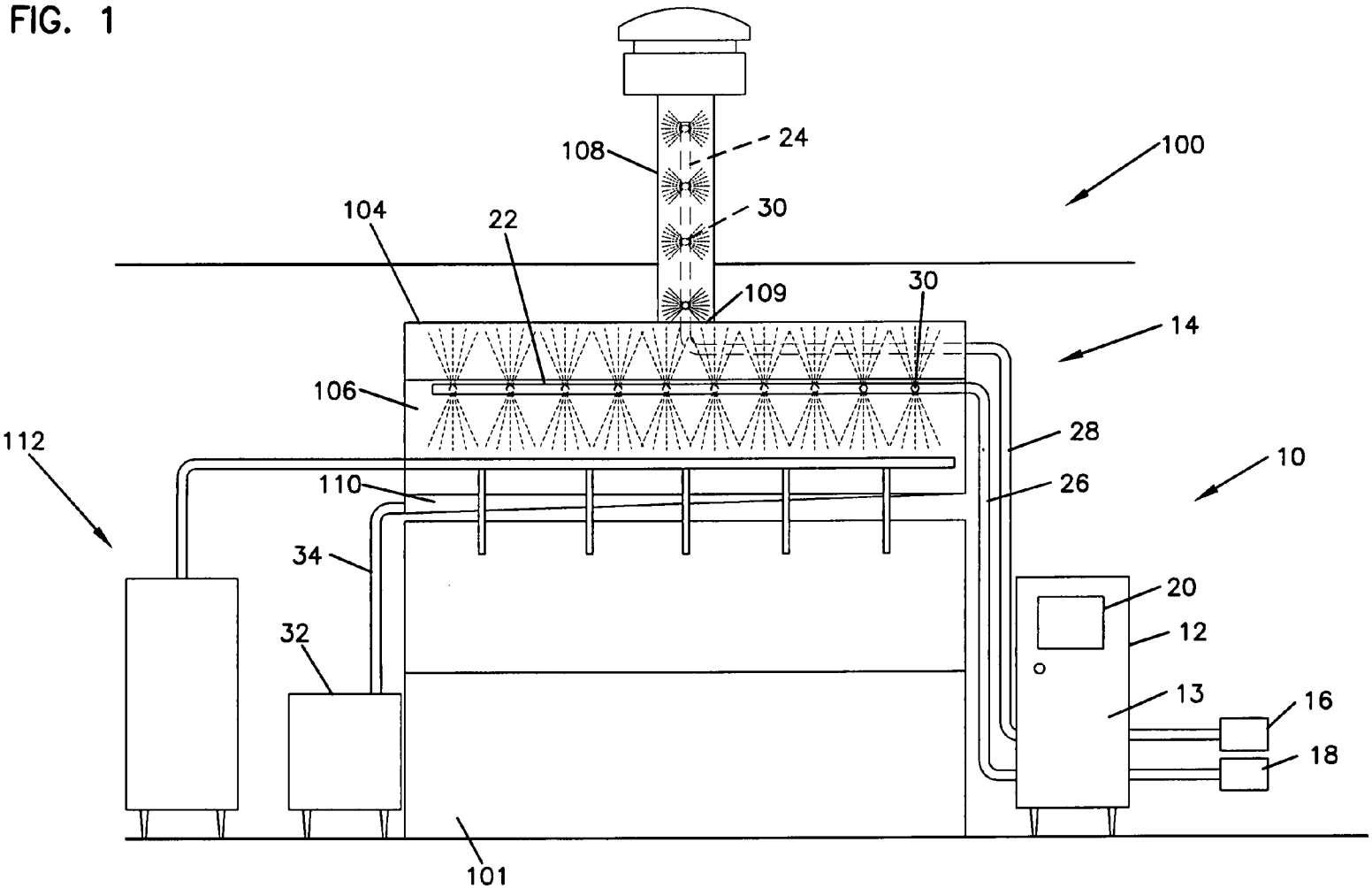
FIG. 1 is a front schematic view of a cleaning system for a cooking range exhaust according to the principles of the present invention.

Referring now to FIG. 1, a front schematic view of a cleaning system 10 for a cooking range exhaust 100 is shown according to an embodiment of the present disclosure. The cooking range exhaust 100 is located in proximity to a cooking area 101. The cooking area 101 can include a range or other cooking or frying appliance. In the embodiment shown, cooking range exhaust 100 is located above the cooking area 101, and includes a range hood 104, a backsplash 106, a flue 108, and a grease trough 110. The backsplash 106 as shown is located within the hood 104. The flue 108 has a flue opening 109 within the range hood 104. A plurality of exhaust filters (not shown) reside within the range hood 104 along its entire length, and are removable for ease of cleaning. One particular exhaust filter adapted for use consistent with the present disclosure is shown below in conjunction with FIGS. 8-9.

The cooking range exhaust 100 can include a fire prevention system 112, which can generally be located at least partially within the range hood 104 and flue 108. The fire prevention system 112 is required by state and federal government regulations for safety reasons, and coexists with the cleaning system 10. It is noted that in the embodiments of this disclosure, the cleaning system 10 remains separate from the fire prevention system 112.

In general, the cleaning system 10 sprays a degreasing composition on a backsplash 106 and flue 108 of the cooking range exhaust 100. After waiting a predetermined time sufficient for the degreasing composition to react with the grease built up on the backsplash 106 and flue 108, the cleaning system 10 sprays water on the same surfaces to rinse the cooking range exhaust 100.

The degreasing composition used in the present disclosure is largely a matter of choice; however it is desired that a chemical capable of loosening grease from metal surfaces in hard to reach areas. Exemplary degreasing compositions that can be used include a composition named Lift-off from GreenTree (Northland), and Powerforce from Ecolab, Inc.

The cleaning system 10 includes a pump system 12 and a fluid delivery system 14. The pump system 12 can be connected to a water source 16 and a degreasing composition source 18, and is constructed for conveying a degreasing composition from the degreasing composition source 18 to the fluid delivery system 14. The pump system 12 can also be constructed to convey water from the water source 16 to the fluid delivery system 14. The degreasing composition source 18 can be a degreasing composition reservoir contained in the pump system 12. Alternately, an external connection from the pump system 12 could lead to a degreasing composition source 18. The water source 16 can be a water reservoir contained in the pump system 12, an attachment to a water spigot, or any other water source capable of supplying sufficient water to rinse the degreasing composition from the backsplash 106 and the flue 108.

The pump system 12 can include a pump 13 that is alternately connected to the degreasing composition source 18 and the water source 16. The pump system 12 can connect the same pump 13 to the degreasing composition source 18 or to the water source 16, such that either degreasing composition or water is propelled by the pump through the fluid delivery system 14. This connection can be, for example, an electronically timed valve or other fluid control system in the pump system 12. The pump system 12 can further include a touch screen 20 that can be used to control the pump 13, or access historical records of pump operation. The touch screen 20 can be electrically connected to a microcontroller and memory (not shown) within the pump system 12 to control pump 13 operation. Of course, alternative control mechanisms such as switches or buttons could be used to control the pump 13 as well. Manual controls can also be incorporated into the pump system 12.

The fluid delivery system 14 includes a hood spray conduit 22 constructed for placement within the hood 104. In the embodiment shown, the hood spray conduit 22 extends along substantially the entire length of the range hood 104 and backsplash 106. In alternate embodiments, the hood spray conduit 22 can extend less than the entire length of the range hood 104.

Figure 4:
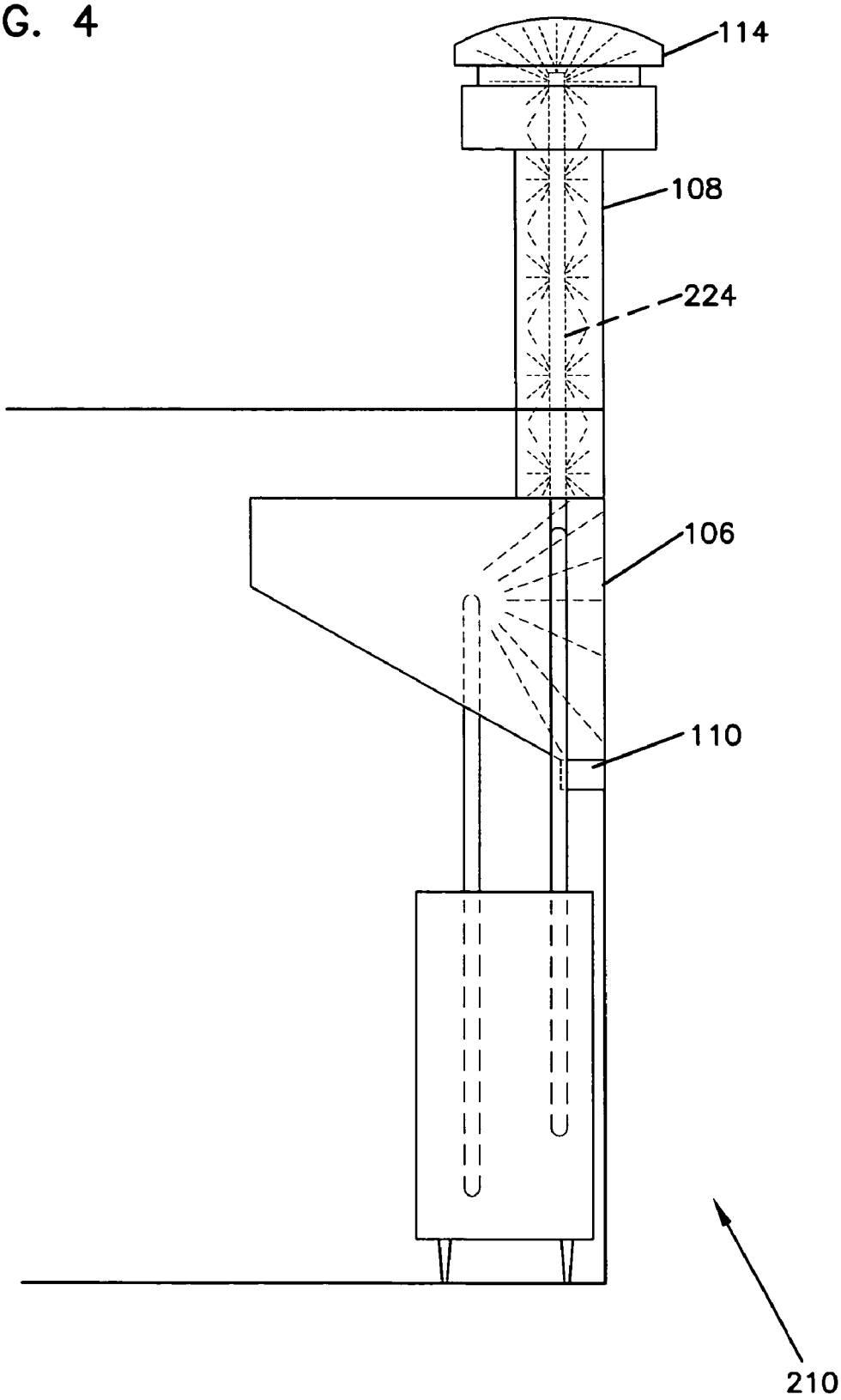
FIG. 4 is a side schematic view of a cleaning system for a cooking range exhaust according to an alternate embodiment of the present disclosure having a fluid conduit reaching into a fan subsystem according to the principles of the present invention.

The fluid delivery system 14 also includes a flue spray conduit 24 constructed for placement within the flue 108. In the embodiment shown, the flue spray conduit extends substantially the entire height of the flue 108. In alternate embodiments, the flue spray conduit 24 can be either shorter or longer than shown. For example, the flue spray conduit can extend into a fan subsystem as shown in FIG. 4.

The hood spray conduit 22 is connected to the pump system 12 by a first connection conduit 26. Likewise, the flue spray conduit 24 is connected to the pump system 12 by a second connection conduit 28. In the embodiment shown, the hood spray conduit 22 is integral with the first connection conduit 26, and the flue spray conduit 24 is integral with the second connection conduit 28. By integral, it is intended that the conduits are formedly attached or commonly manufactured from a single conduit.

In an alternate embodiment, the fluid conduits 22, 24 are not integral with their respective connection conduits 26, 28. Rather, the conduits are joined by a junction piece, such as a sleeve or elbow junction.

Figure 2:
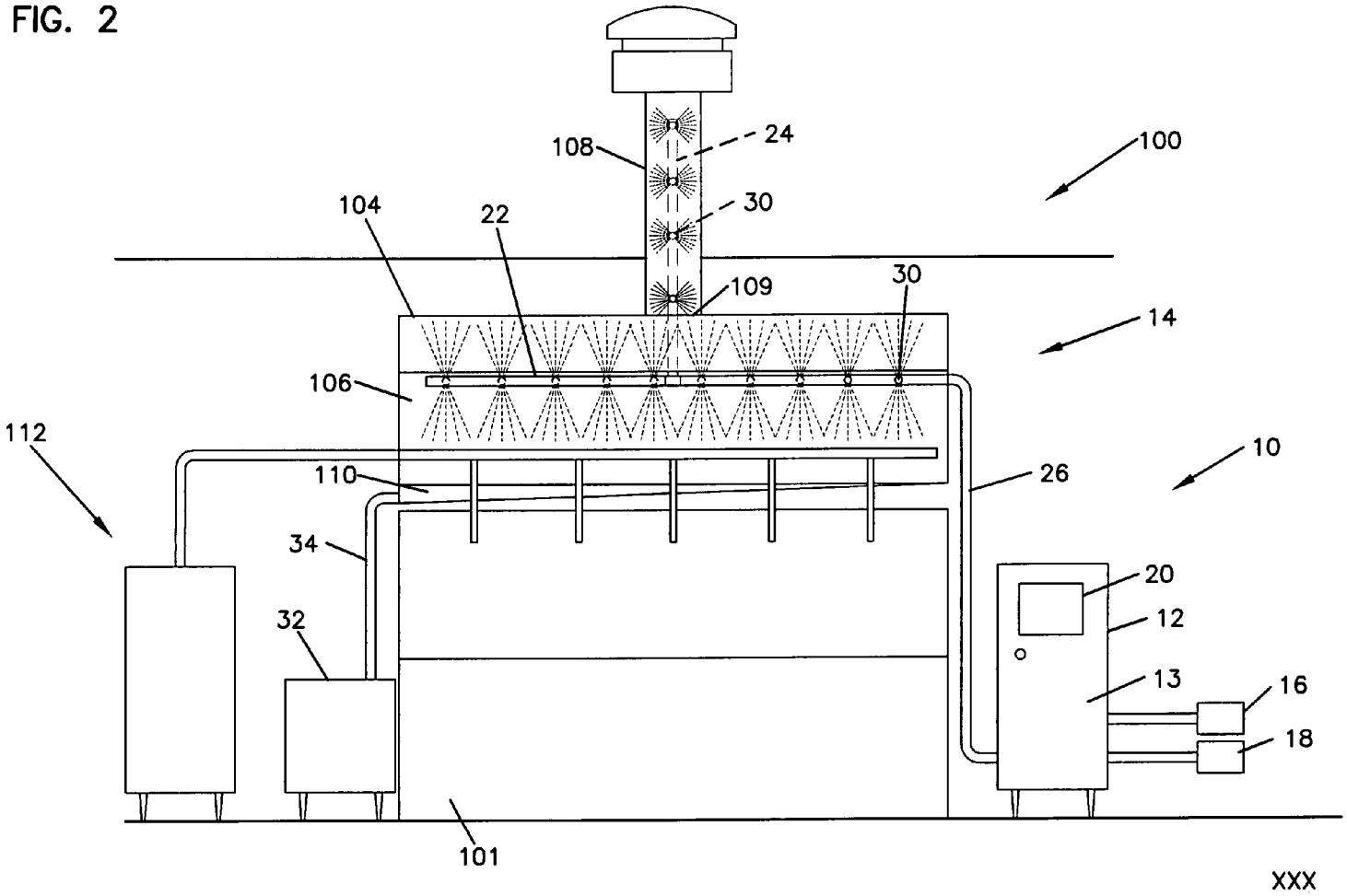
FIG. 2 is a front schematic view of a cleaning system for a cooking range exhaust according to the principles of the present invention.

In alternate embodiments of the present disclosure, the first connection conduit 26 can connect both the hood spray conduit 22 and the flue spray conduit 24 to the pump system 12. In one such embodiment, the flue spray conduit 24 connects to the hood spray conduit 22 within the hood 104, as shown in FIG. 2.

Both the hood spray conduit 22 and the flue spray conduit 24 include spray openings, seen as spray nozzles 30. The spray openings, shown as the spray nozzles 30, are spaced along both the hood spray conduit 22 and the flue spray conduit 24. The spray openings spaced along the hood spray conduit 22 are orientable toward the backsplash 106. The spray openings spaced along the flue spray conduit 24 can be oriented toward an interior surface of the flue 108. This orientation allows the spray nozzles 30 in the hood spray conduit 22 and flue spray conduit 24 to direct the degreasing composition to the backsplash 106 and flue 108, respectively.

Further configurations of the spray openings beyond spray nozzles 30 are possible. For example, the openings may be holes in the first and flue spray conduits 22, 24.

In various embodiments of the present invention, the fluid delivery system 14 can be formed at least in part from stainless steel pipe. The spray nozzles 30 can be, for example, fitted to or welded over openings in the pipe. Of course, other conduit materials could be used, and other methods for attaching spray nozzles 30 could be implemented.

The cleaning system 10 also includes a collection reservoir 32. The collection reservoir 32 is constructed to collect degreasing composition run off from the cooking range exhaust 100. Degreasing composition run off can include the degreasing composition, water used to rinse the degreasing composition from the cooking range exhaust, and cooking effluent removed from the cooking range exhaust by the degreasing composition. Additional cooking, degreasing, or rinsing substances can be included in the degreasing composition run off as well.

In the embodiment shown, the range hood 104 includes a drain or grease trough 110. The cleaning system 10 can include a drain pipe 34 leading from the drain trough 110 to the collection reservoir 32, allowing the degreasing composition run off collecting in the drain trough 110 to migrate to the collection reservoir 32 or drain. Other configurations of the drain pipe 34 and collection reservoir 34 are possible, such as to accommodate cooking range exhausts having different types of drain troughs.

In use, the cleaning system 10 can be programmed via the touch screen 20 on the pump system 12 to activate at a specific time of day. For example, the cleaning system 10 could be programmed to operate at night after use of the cooking area and range exhaust is completed for the day. At the assigned time, the pump system 12 can activate, and can connect the pump 13 to the degreasing composition source 18. The pump system 12 can then force degreasing composition from the degreasing composition source 18, through the fluid delivery system 14, and out spray nozzles 30 spaced along the hood spray conduit 22 and the flue spray conduit 24. The pump system 12 activates pump 13 for a sufficient time to spray the degreasing composition onto the backsplash 106 and at least one interior surface of the flue 108. The pump system 12 can then stop the pump 13, allowing the degreasing composition remaining in the fluid delivery system 14 to drain back through the pump system 12 to the degreasing composition source 18.

The pump system 12 can wait a predetermined time to allow the degreasing composition to allow the degreasing composition to sufficiently contact the grease to allow removal of grease and other contaminants from the affected surfaces of the backsplash 106 and flue 108. For example, the pump system 12 can wait at least three seconds, at least 5 seconds, at least 30 seconds or at least one minute to allow the degreasing composition to sufficiently contact the grease. After sufficient contact, the surface can be rinsed with water. Of course, other predetermined times can be used, and may or may not be programmable in the pump system 12 via the touch screen 20.

The pump system 12 can connect the pump 13 to the water source 16 and force water through the fluid delivery system 14. The water can exit the same spray nozzles 30 as the degreasing composition, and can rinse the degreasing composition from the backsplash 106 and the flue 108. Once sufficient water is pumped by the pump system 12 to rinse the degreasing composition from those surfaces, the pump system 12 can deactivate the pump 13.

The water and rinsed degreasing composition can drain toward the drain trough 110 of the cooking range exhaust 100. The cleaning system 10 allows this degreasing composition run off to drain through the drain trough 110, through a drain pipe 34 to a collection reservoir 32 or a drain.

The degreasing and rinsing can be repeated by the cleaning system 10 one or more times in succession to further clean the cooking range exhaust 100.

The pump system 12 of the present disclosure might only produce suitable force to cause the degreasing composition to mist from the hood spray conduit 22 and the flue spray conduit 24 to reach the backsplash 106 and flue 108. The cleaning system 10 does not require, but does allow, highly-pressurized spray from the spray nozzles 30.

In various embodiments of the present disclosure, the spraying and rinsing steps can be manually or automatically controlled, for example by the pump system as described above. In further embodiments of the present disclosure, the pump system 12 can store a record of the degrease and rinse cycles performed, such that a user or inspector of the cleaning system 10 can readily determine a frequency and/or number of cleanings performed within a given time period.

So, with cleaning system 10 installed, the cooking range exhaust 100 can be considered a self-cleaning exhaust system, in that cleaning hard-to-reach areas such as the backsplash 106 and flue 108 requires limited user involvement. The cleaning system 10 can clean flues of various shapes, such as circular or rectangular, and can be provided without use of rotating parts.

Referring now to FIG. 2, a front schematic view of a cleaning system 10 for a cooking range exhaust 100 is shown according to an embodiment of the present disclosure. In this embodiment, the fluid delivery system includes a first connection conduit 26 that connects the hood spray conduit 22 and the flue spray conduit 24 to the pump system 12. The flue spray conduit 24 is connected to the hood spray conduit 22. This configuration of the hood spray conduit 22 and the flue spray conduit 24 allows the pump system 12 to convey the degreasing composition or water through the fluid delivery system 14 via a single conduit, shown as first connection conduit 26. In an alternate embodiment, the pump system 12 can be directly connected to the hood spray conduit 22 without a connection conduit.

Figure 3:
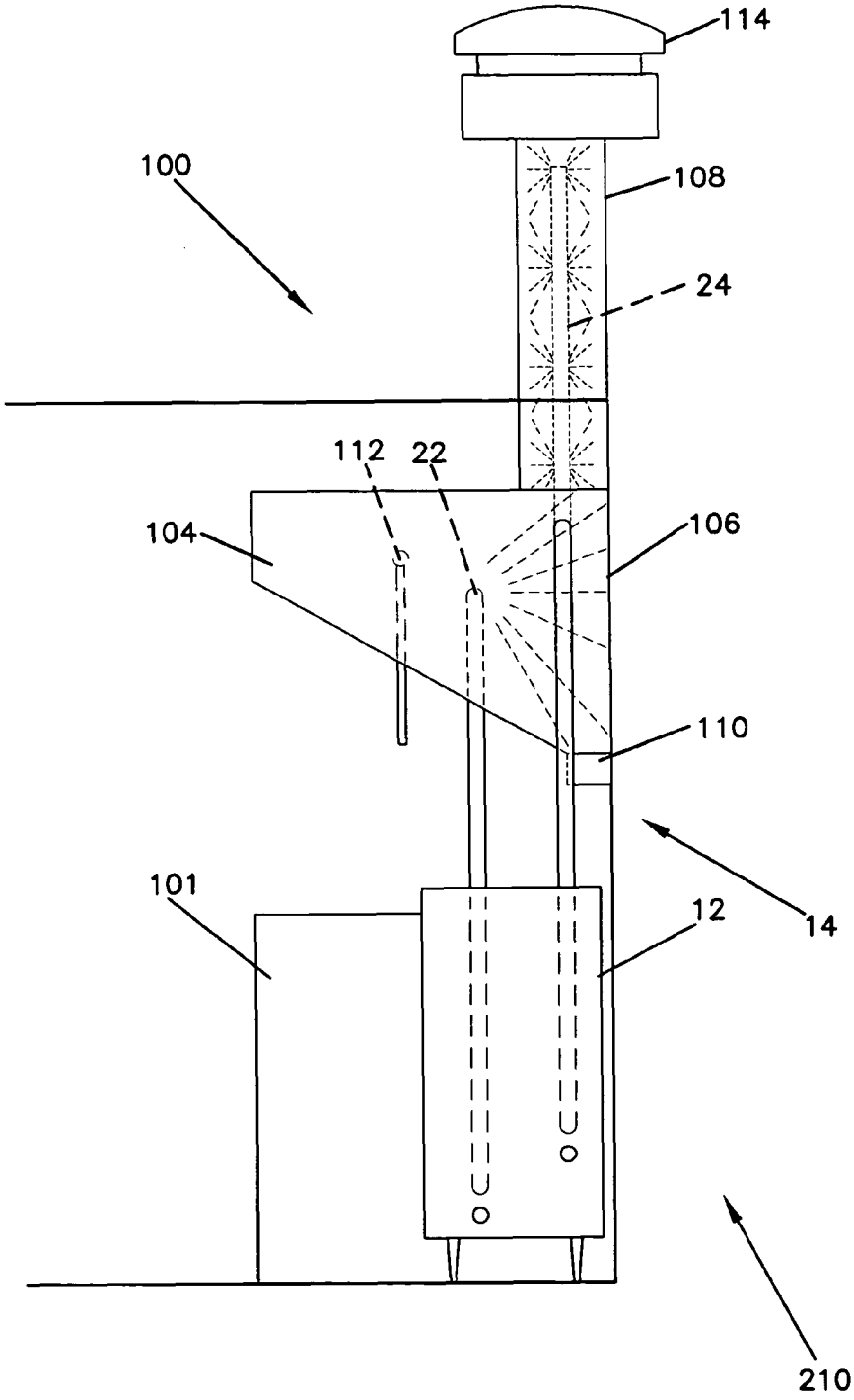
FIG. 3. is a side schematic view of the cleaning system of FIG. 1.

Referring now to FIG. 3, a side schematic view of the cleaning system 10 of FIG. 1 is shown. In the embodiment shown, the pump system 12 resides next to a cooking area 101. The hood spray conduit 22 and first connection conduit 26 are integral, and connect to the pump system 12. Spray openings are oriented toward the backsplash 106 within range hood 104. The flue spray conduit 24 and second connection conduit 28 are integral and connected to the pump system 12 as well, and spray openings on the flue spray conduit 24 are oriented toward the surfaces of the flue 108. At the top of the flue, a fan subsystem 114 is located above a terminating end of the flue spray conduit 24.

Degreasing composition and water draining from the backsplash 106 and the flue 108 can migrate to the drain trough 110 and away from the cooking range exhaust 100 via the drain pipe and collection reservoir (seen, for example, in FIG. 1).

It is noted that in the embodiments shown, the fluid delivery system 14 remains separate from a fire prevention system 112 that can be located at least partially within the range hood 104 and flue 108. The fire prevention system 112 may be required by state and federal government regulations for safety reasons, and coexists with the cleaning system 10. For clarity, the fire prevention system 112 is not included in the remaining figures; however, it is understood to continue to be present in the cooking range exhaust 100.

Referring now to FIG. 4, a side schematic view of a cleaning system 210 for a cooking range exhaust 100 is shown according to an alternate embodiment of the present disclosure. In this embodiment, the flue spray conduit 224 extends into a fan subsystem 114 of the cooking range exhaust 100. At least one of the spray openings is constructed to direct the degreasing composition toward an interior surface of the fan subsystem 114.

The flue spray conduit 224 can extend into the fan subsystem 114 regardless of the connection within the hood 104. In an alternate embodiment, the flue spray conduit 224 can connect to the hood spray conduit, as shown in FIG. 2.

As in FIG. 3, degreasing composition run off and water draining from the backsplash 106, the flue 108, and the fan subsystem 114 migrate to the drain trough 110 and away from the cooking range exhaust 100 via the drain pipe and collection reservoir or drain.

Figure 5:
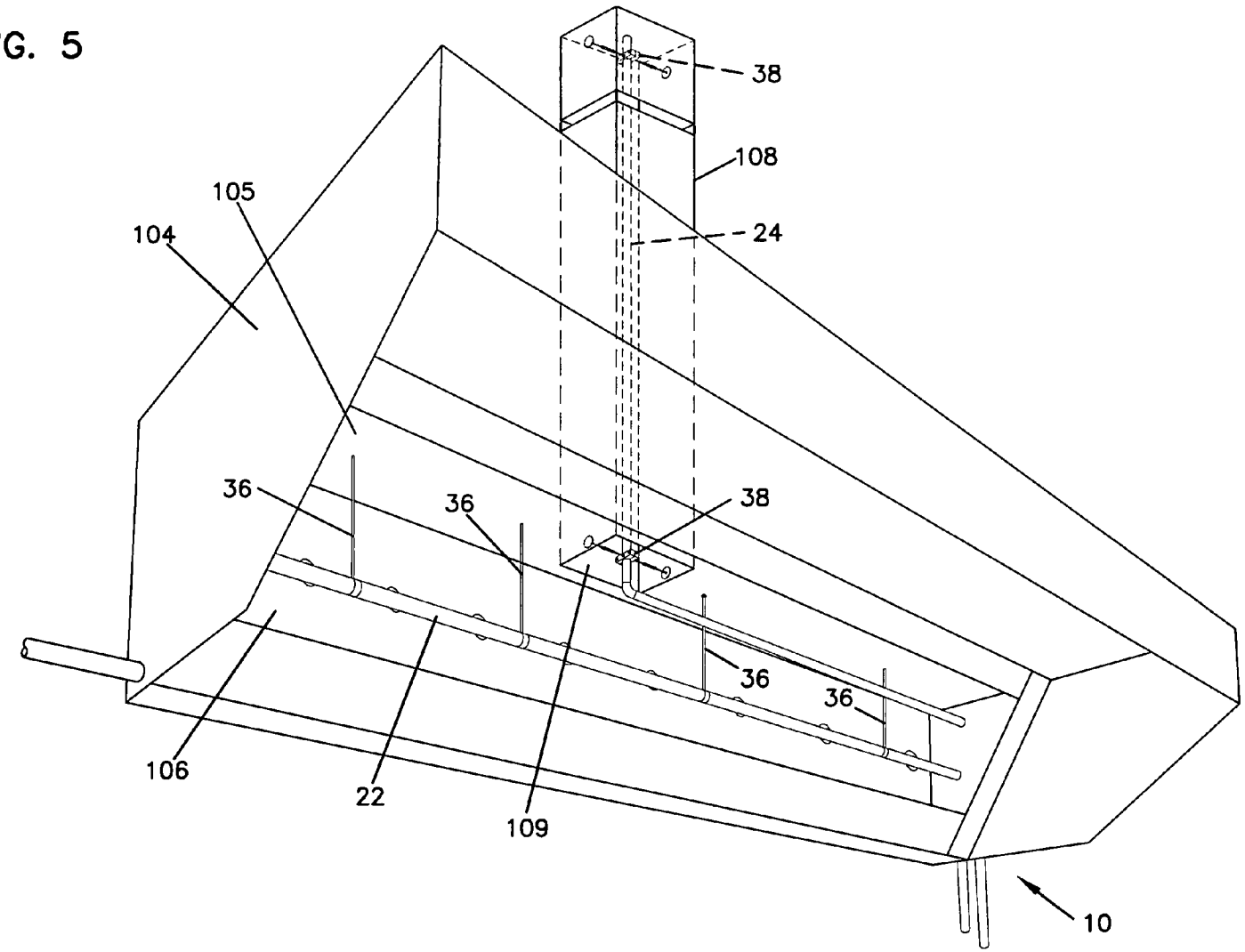
FIG. 5 is a perspective schematic view of a portion of a cleaning system for a cooking range exhaust according to the principles of the present invention.

Referring now to FIG. 5, a perspective schematic view of a portion of a cleaning system 10 is shown according to an embodiment of the present disclosure. In the embodiment shown, a mounting arrangement for the hood spray conduit 22 and the flue spray conduit 24 are shown.

In the embodiment shown, the hood spray conduit 22 is held in a position along the backsplash 106 with mounting brackets 36. The mounting brackets 36 can attach to the range hood 104 at one or more positions. The mounting brackets 36 can extend from a top portion 105 of range hood 104, such that the hood spray conduit 22 resides approximately halfway down the backsplash 106. The hood spray conduit 22 can be held at a distance from the backsplash 106 sufficient to allow the spray nozzles to propel the degreasing composition and the water to substantially the entire surface of the backsplash 106.

The flue spray conduit 24 can be held within the flue 108 by at least one mounting clamp 38. In the embodiment shown, two mounting clamps 38 can hold the flue spray conduit 24 substantially centrally within the flue 108. One of the mounting clamps 38 can be located near the flue opening 109 from the flue 108 to the range hood 104. In such an embodiment, spray openings (such as spray nozzles 30 of FIG. 1) are located on all sides of the flue spray conduit 24.

In an alternate embodiment of the cleaning system 10 shown, for example, in FIG. 2, the flue spray conduit 24 can connect to the hood spray conduit 22, such as below the flue opening 109.

Figure 6:
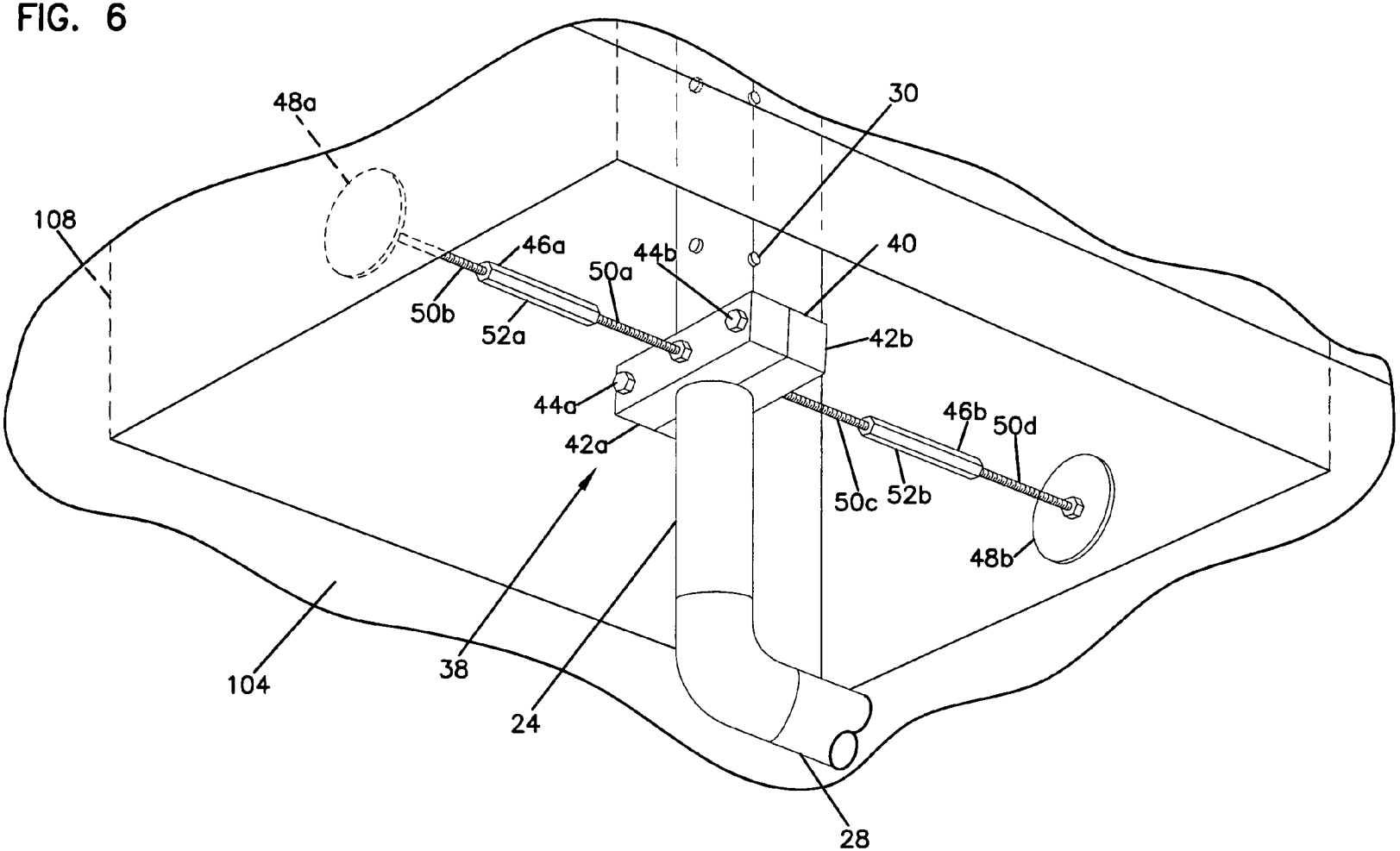
FIG. 6 is a detailed schematic view of a portion of the cleaning system of FIG. 5.

Referring now to FIG. 6, a detailed schematic view of a portion of the cleaning system 10 of FIG. 5 is shown. In the embodiment shown, a mounting clamp 38 is shown holding the flue spray conduit 24 within the flue 108 at the flue opening 109 of the flue 108 into the range hood 104.

In the embodiment shown, the mounting clamp 38 can be located above the junction of the flue spray conduit 24 and the second connection conduit 28, and below the spray nozzles 30. The mounting clamp 38 can include a clamp body 40 surrounding the flue spray conduit 24. The clamp body 40 can be constructed from two opposed segments 42*a*, 42*b* formed around the flue spray conduit 24 and bolted together with bolts 44*a*, 44*b*. Alternative configurations of the clamp body 40 are possible as well.

Two opposed adjustable legs 46*a*, 46*b* can extend from opposite sides of the clamp body 40, and can be terminated at feet 48*a*, 48*b*. Each leg 46 can adjust in length, and can adapt to the size of the flue 108 in which the flue spray conduit 24 is installed. In the embodiment shown, the legs 46*a*, 46*b* each include two threaded rods 50*a-b*, 50*c-d*, respectively, each leg joined by a threaded spacer 52*a*, 52*b* that allows for such adjustment.

Once installed, friction between the interior walls of the flue 108 and the feet 48*a*, 48*b* holds the mounting clamp 38 and flue spray conduit 24 in the flue 108, eliminating the need for drilling holes or adding mounting screws within the flue 108. In an alternate embodiment, mounting screws or other structure could be used to fix the mounting clamp 38 to the flue 108.

Figure 7:
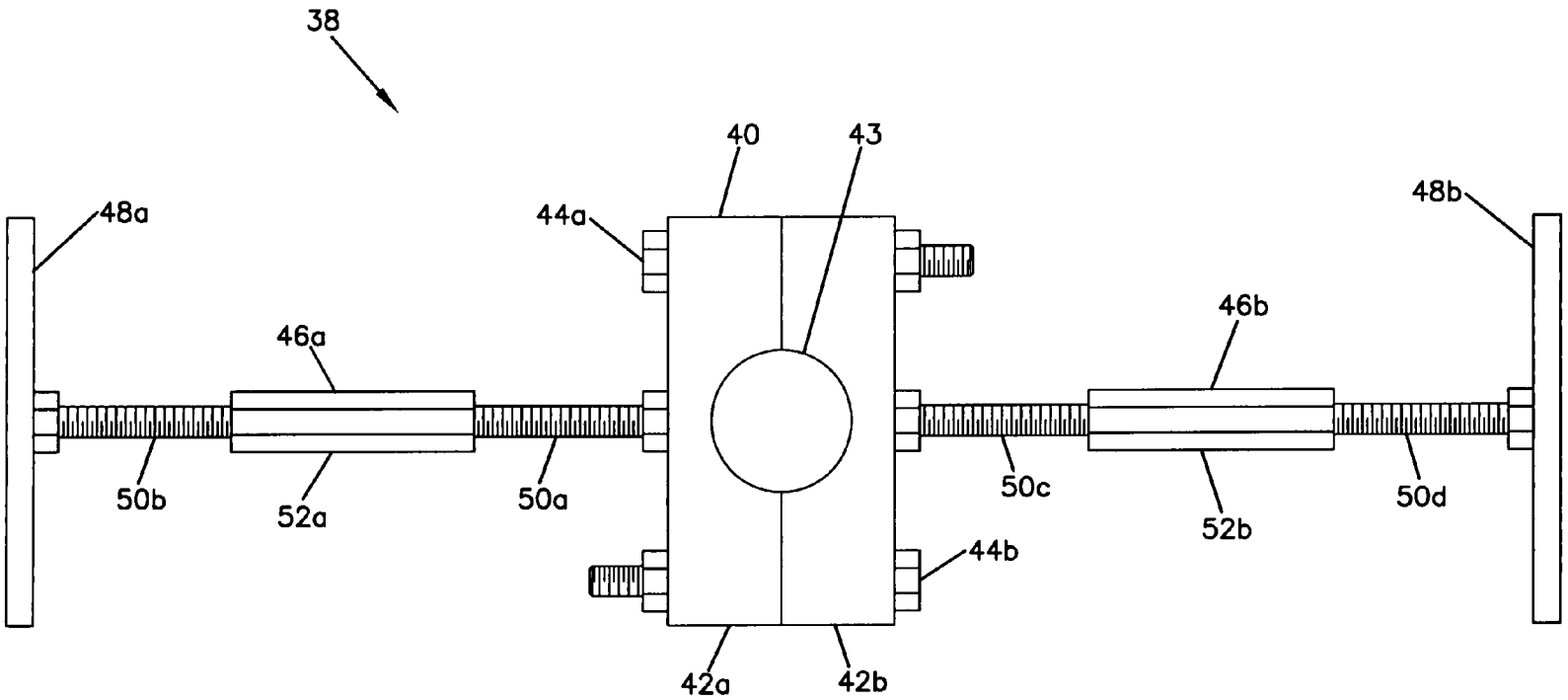
FIG. 7 is a front schematic view of a mounting clamp used to mount portions of the cleaning system within the cooking range exhaust according to the principles of the present invention.

Referring now to FIG. 7, a front schematic view of a mounting clamp 38 used to mount portions of the cleaning system 10 within the flue 108 is shown according to an embodiment of the present disclosure. In the embodiment shown, the mounting clamp 38 has a clamp body 40 formed from two opposed segments 42*a*, 42*b*. The opposed segments are connected with bolts 44*a*, 44*b*, and form an aperture 43 sized to receive the flue spray conduit 24 of FIGS. 1-6. Bolts 44*a*, 44*b* are fed through holes in the opposed segments 42*a*, 42*b* in opposite directions. Alternately, the bolts 44*a*, 44*b* can be inserted through the opposed segments 42*a*, 42*b* from the same direction.

The mounting clamp 38 can include two opposed adjustable legs 46*a*, 46*b* that extend from opposite sides of the clamp body 40, and are terminated at feet 48*a*, 48*b*. The legs 46*a*, 46*b* can each include threaded rods 50*a-b*, 50*c-d*, respectively, where each leg 46 is joined by a threaded spacer 52*a*, 52*b* that allows for adjustment of the legs to lengthen or shorten the leg accordingly in order to fit within varied sizes of flues 108.

Feet 48*a*, 48*b* can be screwed or affixed to the end of the legs 44, and act to spread out the force applied to the interior walls of the flue 108, and to hold the flue spray conduit in place. The feet 48 can be any shape, although in the embodiment shown, disc-shaped feet are used.

Figure 8:
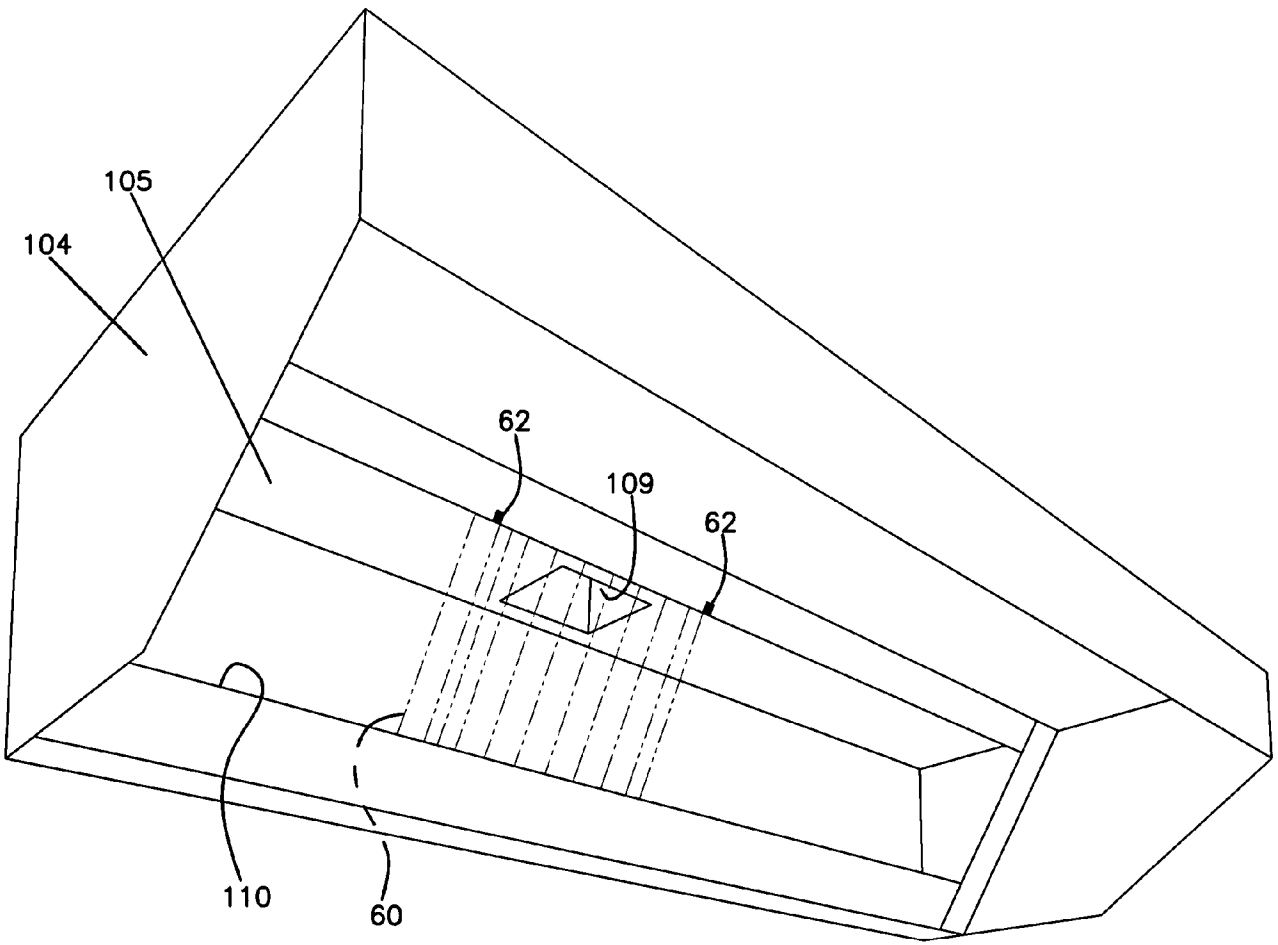
FIG. 8 is a perspective schematic view of a range hood with an exhaust filter according to the principles of the present invention.

Referring now to FIG. 8, a perspective schematic view of the range hood 104 with an exhaust filter 60 installed is shown according to an embodiment of the present disclosure. Standard exhaust filters (not shown) are typically shorter segments that extend from the top portion 105 of the range hood 104 to the drain trough 110 and are placed side-by-side within the entire length of the range hood 104. The exhaust filters are constructed to catch grease and allow the grease and other contaminants to drain into the drain trough 110. Although these short segments of filter are easily handled, small gaps remain between the filter segments that allow slight drippage of grease back onto the cooking area. This problem can be exacerbated in the location directly under the flue opening 109 due to the increased amount of degreasing composition run off draining out of the flue 108. Hence, the present disclosure includes the extended exhaust filter 60 in the range hood 104. The exhaust filter 60 can reduce or prevent flow of the degreasing composition run off onto the cooking surface.

The exhaust filter 60 is shown in broken lines installed within the range hood 104. The exhaust filter 60 extends from a top portion 105 of the range hood 104 to the drain trough 110. The exhaust filter 60 is longer than the standard exhaust filters described above, and in the embodiment shown is sized such that it extends at least 10 inches past either edge of the flue opening 109 leading to the flue. This sizing limits the amount of degreasing composition run off dripping from the flue opening 109 and onto the cooking area 101. Other filters of various sizes longer than the flue opening 109 could be used as well.

In one embodiment, the exhaust filter 60 is constructed from two standard sized exhaust filters welded or otherwise fixed together such that no gap is allowed at the center of exhaust filter 60. Additional standard exhaust filters are added to the range hood 104 to fill the remainder of the range hood not below the flue opening 109 to the flue 108 where exhaust filter 60 resides.

Exhaust filter 60 and the standard exhaust filters (not shown) residing within the range hood 104 are removable for cleaning. One or more markers 62 can be located on the range hood 104 denoting the proper location of exhaust filter 60 such that a user can readily determine the proper spacing and location to prevent leakage from the flue 108 onto the cooking area 101. The markers 62 can be painted, etched, or otherwise attached to the range hood 104. In the embodiment shown, two markers 62 denotes the proper location of the edges of the exhaust filter 60.

Figure 9:
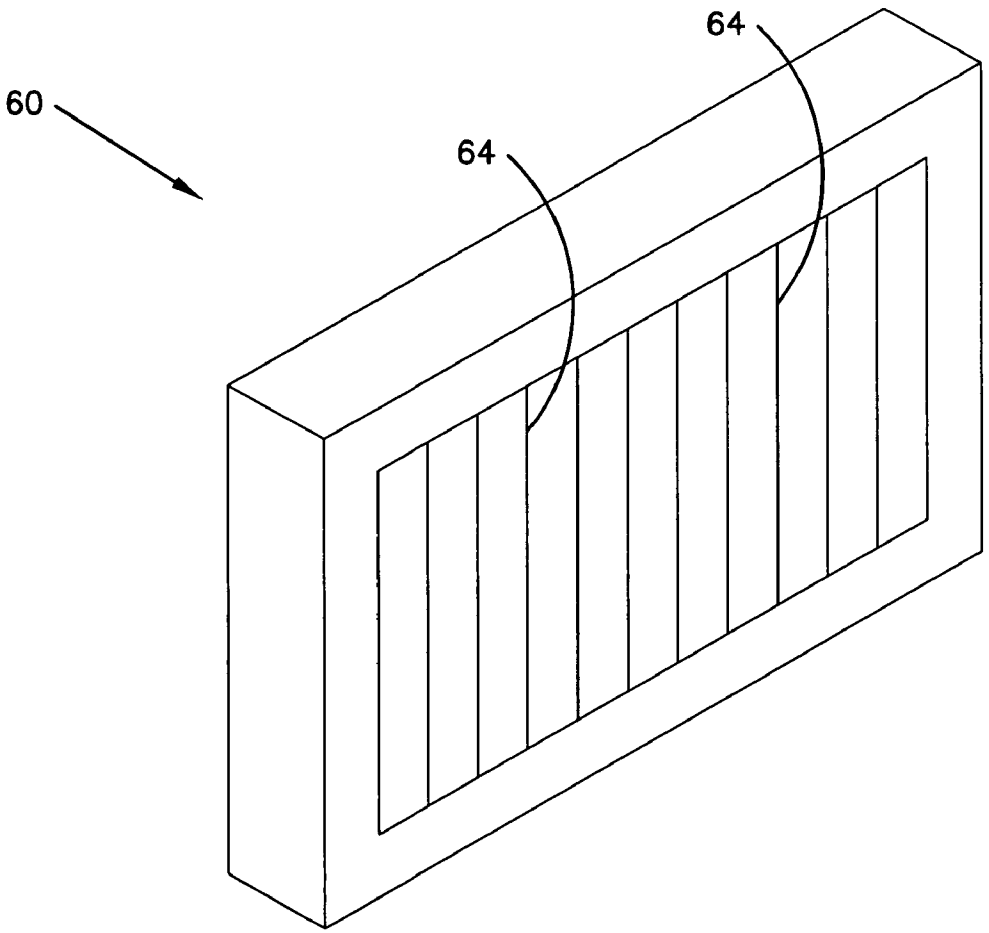
FIG. 9 is a perspective schematic view of an exhaust filter according to the principles of the present invention.

Referring now to FIG. 9, a perspective schematic view of an exhaust filter 60 used to implement aspects of the present disclosure is shown. The exhaust filter 60 includes a series of ridges 64 incorporated into a central area of each side of the filter 60. The ridges allow ingress of grease, water, and other liquids into the central volume of the filter 60 defined by the length, width, and depth of the filter 60. Drainage holes (not shown) are located along a bottom edge of the filter 60, and allow the gathered liquid to exit the filter. When the filter 60 is installed in the range hood 104 (as in FIG. 8), the holes reside in the drain trough 110, and liquids exiting filter 60, such as degreasing composition run off, drain directly into the drain trough 110.

An advantage of the invention is the ability to clean an exhaust system periodically and with minimal effort. In addition, the cleaning system 10 can be installed without having to cut through the exhaust system flue and the fire wrap that typically wraps an exhaust system flue. Accordingly, an exhaust system can be conveniently retrofit with the cleaning system 10 according to the invention.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A cleaning system for cleaning a cooking range exhaust having a hood, a backsplash, and a flue for exhausting cooking effluent, the cleaning system comprising:

a fluid delivery system constructed for placement within the cooking range exhaust, the fluid delivery system, including a hood spray conduit constructed for placement within the hood and adjacent an interior surface of the backsplash defining an outer perimeter portion of the cooking range exhaust, the hood spray conduit longitudinally traversing a substantial portion of the backsplash and comprising a plurality of spray openings for directing a degreasing composition to substantially the entire interior surface of the backsplash at a first time, and a flue spray conduit constructed for placement within the flue and comprising a plurality of spray openings for directing the degreasing composition to substantially an entire interior surface of the flue at the first time, at least one of the spray openings configured to vertically spray the degreasing composition into a fan subsystem located vertically above a top end of the flue spray conduit; and a pump system constructed for conveying the degreasing composition from a degreasing composition source and through the fluid delivery system.

2. The cleaning system of claim 1, wherein:

the fluid delivery system further comprises a first connection conduit connecting the hood spray conduit to the pump system along a first fluid path and a second connection conduit connecting the flue spray conduit to the pump system along a second fluid path spaced from the first fluid path, the spaced first and second fluid paths extending from the pump system to the hood spray conduit and the flue spray conduit, respectively.

3. The cleaning system of claim 1, wherein:

the flue spray conduit connects to the hood spray conduit within the cooking range exhaust; and the fluid delivery system further comprises a first connection conduit connecting the hood spray conduit and the flue spray conduit to the pump system.

4. The cleaning system of claim 1, wherein:

each of the spray openings comprise a fixed spray nozzle.

5. The cleaning system of claim 1, wherein:

the flue spray conduit extends into the fan subsystem, an axis of the top end of the flue spray conduit oriented substantially parallel with an axis of the fan subsystem.

6. The cleaning system of claim 1, wherein:

the pump system is further constructed for conveying water from a water source and through the fluid delivery system.

7. The cleaning system of claim 6, wherein:

the pump system includes a pump configured to alternate between connection to the degreasing composition source and connection to the water source.

8. The cleaning system of claim 1, further comprising:

at least one non-penetrable mounting clamp constructed to hold the flue spray conduit at least partially within the flue, the at least one non-penetrable mounting clamp terminating in one or more feet frictionally engaging an interior surface of the flue without penetrating the flue.

9. The cleaning system of claim 8, wherein:

the at least one non-penetrable mounting clamp includes two opposed adjustable legs that extend from opposite sides of a clamp body.

10. The cleaning system of claim 8, wherein:

the at least one non-penetrable mounting clamp includes at least a first non-penetrable mounting clamp positioned within a first flue portion and a second non-penetrable mounting clamp positioned within a second flue portion, spaced from the first flue portion.

11. The cleaning system of claim 1, further comprising:

a user-interface integrated with the pump system allowing control and programming of the pump system.

12. The cleaning system of claim 11, wherein:

the user-interface instructs the pump system to convey the degreasing composition at a first time and convey water at a second time succeeding the first time.

13. The cleaning system of claim 12, wherein:

the user-interface performs the water conveyance at least three seconds after the degreasing conveyance.

14. The cleaning system of claim 12, wherein:

the user-interface repeats the first time degreasing conveyance and the second time water conveyance at a frequency of at least once a day.

15. The cleaning system of claim 11, wherein:

the user-interface includes a memory storing a performance history of the pump system.

16. The cleaning system of claim 1, wherein each of the plurality of spray openings comprise a fixed spray nozzle; and wherein an axis defining the flue spray conduit is parallel with the plane defining the entire interior surface of the backsplash.

17. The cleaning system of claim 1, wherein degreasing composition run-off is gravitationally discharged through a drain pipe couplable to a drain trough of the hood.

18. The cleaning system of claim 1, wherein:

the hood spray conduit is non-rotating relative to the hood; and the flue spray conduit is non-rotating relative to the flue.

19. A cleaning system for cleaning a cooking range exhaust having a hood, a backsplash, and a flue for exhausting cooking effluent, the cleaning system comprising:

a fluid delivery system constructed for placement within the cooking range exhaust, the fluid delivery system, including a non-rotating hood spray conduit constructed for placement within the hood and comprising a plurality of fixed spray openings for directing a degreasing composition to substantially an entire interior surface of the backsplash that is free of venting voids and directly exposed to the exhausting cooking effluent as it is drawn upwardly through the flue, the hood spray conduit having a length traversing a substantial portion of the backsplash, and a non-rotating flue spray conduit constructed for placement within the flue and comprising a plurality of spray openings for directing the degreasing composition to substantially an entire interior surface of the flue;

a pump system constructed for conveying the degreasing composition from a degreasing composition source and through the fluid delivery system; and a user-interface integrated with the pump system allowing control and programming of the pump system, the user-interface including a memory storing a performance history of the pump system.

20. The cleaning system of claim 19, wherein:

the pump system is further constructed for conveying water from a water source and through the fluid delivery system.

21. The cleaning system of claim 19, further comprising:

at least one non-penetrable mounting clamp constructed to hold the flue spay conduit at least partially within the flue, the at least one non-penetrable mounting clamp terminating in one or more feet frictionally engaging an interior surface of the flue without penetrating the flue.

22. The cleaning system of claim 21, wherein:

the at least one non-penetrable mounting clamp includes two opposed adjustable legs that extend from opposite sides of a clamp body.

23. The cleaning system of claim 19, wherein:

the flue spray conduit extends into a fan subsystem located vertically above, and substantially aligned with, an axis of a top end of the flue spray conduit, or at least one spray opening of the flue spray conduit is vertically directed toward an interior surface of the fan subsystem.

24. The cleaning system of claim 19, wherein:

the pump system conveys the degreasing composition to the plurality of spray openings of the hood spray conduit such that the degreasing composition is directed to the entire interior surface of the backsplash at approximately the same time, the entire interior surface of the backsplash to which degreasing composition is directed defining an outer perimeter portion of the cooking range exhaust.

25. The cleaning system of claim 19, wherein:

the pump system conveys the degreasing composition to the plurality of spray openings of the flue spray conduit such that the degreasing composition is directed to the entire interior surface of the flue at approximately the same time.

26. The cleaning system of claim 19, wherein:

each of the plurality of spray openings comprise a fixed spray nozzle.

27. The cleaning system of claim 19, wherein:

the flue spray conduit connects to the hood spray conduit within the cooking range exhaust; and the fluid delivery system further comprises a first connection conduit connecting the hood spray conduit and the flue spray conduit to the pump system.

* * * * *